US009987736B2

(12) United States Patent
Arboleda

(10) Patent No.: US 9,987,736 B2
(45) Date of Patent: Jun. 5, 2018

(54) PUNCH CENTERING BLOCK DEVICE

(71) Applicant: Salomon Valencia Arboleda, Surrey (CA)

(72) Inventor: Salomon Valencia Arboleda, Surrey (CA)

( * ) Notice: Subject to any disclaimer, the term of this patent is extended or adjusted under 35 U.S.C. 154(b) by 108 days.

(21) Appl. No.: 15/268,655

(22) Filed: Sep. 19, 2016

(65) Prior Publication Data

US 2018/0079063 A1 Mar. 22, 2018

(51) Int. Cl.
*B25D 5/00* (2006.01)

(52) U.S. Cl.
CPC ..... *B25D 5/00* (2013.01)

(58) Field of Classification Search
CPC ..... B25D 5/00
USPC ..... 33/574, 666, 670, 671
See application file for complete search history.

(56) References Cited

U.S. PATENT DOCUMENTS 1,378,287 A * 5/1921 Shaylor ..... B25D 5/00 33/676
1,505,775 A * 8/1924 Gail ..... B26F 1/36 30/358
2,417,638 A 4/1945 Egowin
2,757,457 A * 8/1956 Ziegelski, Sr. ..... B25D 5/00 30/366
2,855,694 A 8/1956 Rasmusson
2,830,378 A 4/1958 Givan
2,834,116 A 5/1958 Hambrick
2,860,421 A * 11/1958 Smith ..... B25D 5/00 33/671
3,013,340 A 12/1961 Fairbanks
3,015,889 A * 1/1962 Godman ..... B25D 5/00 33/27.03
3,816,933 A 6/1974 Dillinger
4,069,586 A * 1/1978 Skelton ..... B25D 5/00 30/360
4,958,441 A 9/1990 Bigelow
4,993,168 A 2/1991 Acuna
5,596,809 A * 1/1997 Beard ..... B26B 5/005 30/310
5,878,505 A * 3/1999 Scarpellini ..... G01C 15/04 33/1 G
6,029,362 A 2/2000 Miodragovic
(Continued)

FOREIGN PATENT DOCUMENTS

CN 201419206 Y 3/2010
DE 2453032 A1 5/1976
(Continued)

*Primary Examiner* — G. Bradley Bennett

(57) ABSTRACT

A punch centering block device can include a first block and a second block. The first block can define a first reference surface and a first notch extending along a first axis. The first reference surface can lay flush on a workpiece. The first axis can be transverse to the first reference surface. The second block can define a second reference surface and a second notch extending along a centered second axis. The second reference surface can lay flush on the workpiece. The second axis can be transverse to the second reference surface. The first block and the second block can selectively abut one another and render the first axis and second axis collinear to receive a punch. The punch is slidable against the first notch and the second notch during the marking operation.

20 Claims, 8 Drawing Sheets

(56) References Cited

U.S. PATENT DOCUMENTS

| | | | | |
|---|---|---|---|---|
| 6,036,332 | A * | 3/2000 | Antal | B25D 5/00 33/670 |
| 8,806,766 | B1 | 8/2014 | Lee | |
| 2002/0189119 | A1 | 12/2002 | High | |
| 2004/0149149 | A1 | 8/2004 | Schneider | |
| 2004/0177527 | A1* | 9/2004 | Prevost | A47G 1/205 33/613 |
| 2006/0130348 | A1* | 6/2006 | Lyman, Jr. | B23Q 9/0042 33/520 |
| 2010/0170100 | A1* | 7/2010 | Weigel | B25D 5/00 33/520 |

FOREIGN PATENT DOCUMENTS

| | | | |
|---|---|---|---|
| JP | 02124284 | H | 5/1990 |
| JP | 04360793 | H | 12/1992 |

* cited by examiner

FIGURE 8A1
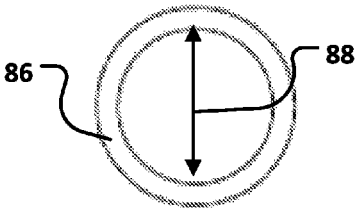
FIGURE 8B1
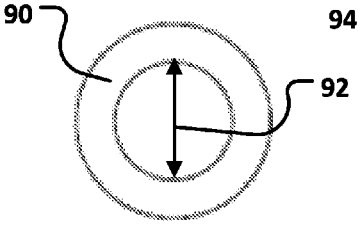
FIGURE 8C1
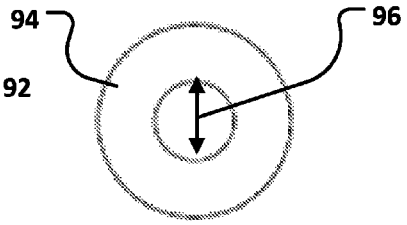
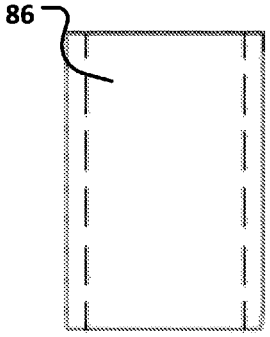
FIGURE 8A2
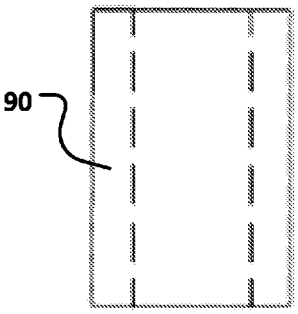
FIGURE 8B2
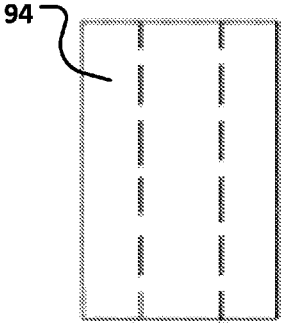
FIGURE 8C2

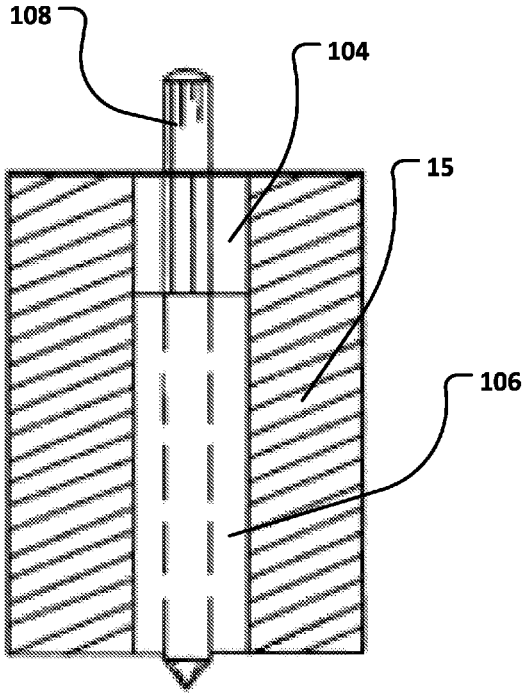
FIGURE 9
FIGURE 12
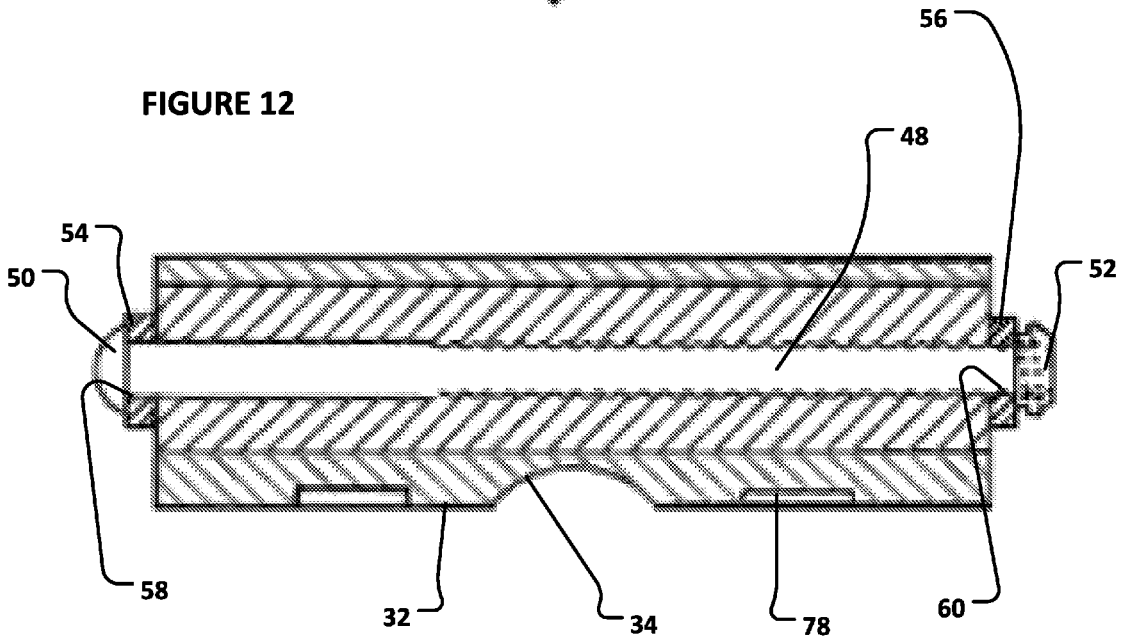

PUNCH CENTERING BLOCK DEVICE

BACKGROUND

1. Field

The present disclosure relates to a geometrical instrument for applying an indicia to a surface of a workpiece in order to guide further operations on the workpiece, such as a cutting, grinding or stamping operation.

2. Description of Related Prior Art

U.S. Pat. No. 4,958,441 discloses a center punch block device. The center punch block device has a main body including a level pivotally mounted thereto within a slot transversely oriented within the block and transversely arranged to an elongate "V" slot formed within a lowermost surface of the body to accept elongate workpieces therewithin to enable alignment of the workpieces within the "V" shaped slot wherein a punch orthogonally oriented relative to the "V" shaped slot produces an indicator mark upon impacting of an upper end of the punch.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A punch centering block device can include a first block and a second block. The first block can define at least one first reference surface and at least one first notch extending along a centered first axis. The at least one first reference surface can have a first predetermined level of flatness and can thereby be configured to lay flush on a first surface portion of a workpiece. The first axis can be transverse to the at least one first reference surface. The second block can define at least one second reference surface and at least one second notch extending along a centered second axis. The at least one second reference surface can have a second predetermined level of flatness and can thereby be configured to lay flush on a second surface portion of the workpiece. The second axis can be transverse to the at least one second reference surface. The first block and the second block can be configured to selectively abut one another and render the first axis and second axis collinear such that the at least one first notch defines a first radial half of a punch aperture configured to receive a punch during a marking operation and the at least one second notch defines a second radial half of the punch aperture. The punch is slidable against the at least one first notch and the at least one second notch within the punch aperture during the marking operation.

BRIEF DESCRIPTION OF THE DRAWINGS

The detailed description set forth below references the following drawings:

FIG. 8A1 is a top view of a first sleeve according to an exemplary embodiment of the present disclosure;

FIG. 8A2 is a front view of the first sleeve;

FIG. 8B1 is a top view of a second sleeve according to an exemplary embodiment of the present disclosure;

FIG. 8B2 is a front view of the second sleeve;

FIG. 8C1 is a top view of a third sleeve according to an exemplary embodiment of the present disclosure;

FIG. 8C2 is a front view of the third sleeve;

FIG. 9 is a section view taken along section lines 9-9 in FIG. 6;

FIG. 12 is a section view taken along section lines 12-12 in FIG. 5.

DETAILED DESCRIPTION

Figure 1:
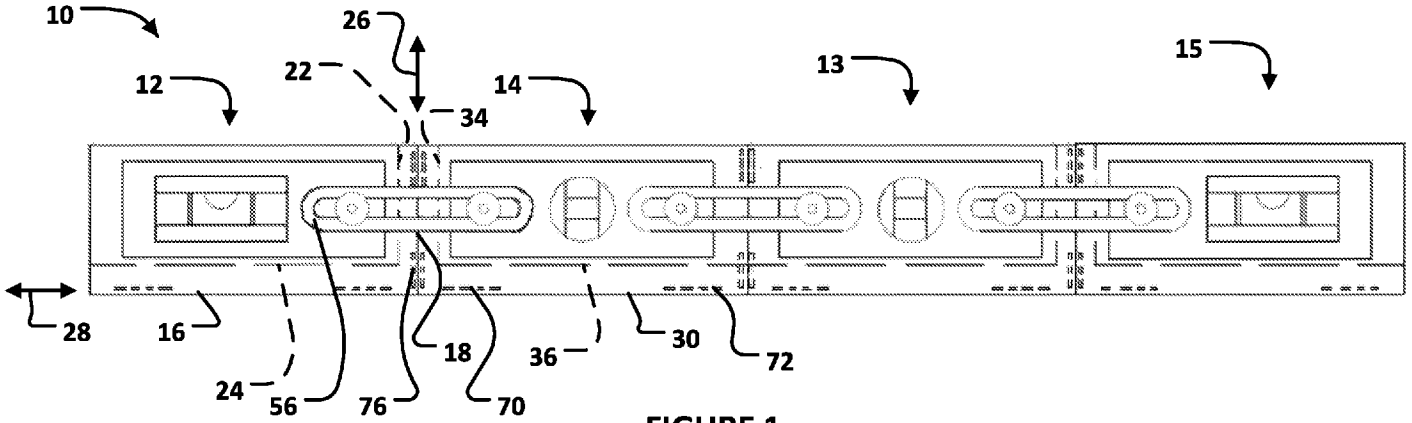
FIG. 1 is a front view of a punch centering block device according to an exemplary embodiment of the present disclosure.

Referring now to the various figures, a punch centering block device 10 can include a first block 12 and a second block 14. The exemplary punch centering block device 10 also includes a third block 13 and a fourth block 15. The blocks 12, 13, 14, 15 are pivotally connected to one another, as will be set forth in greater detail below. In the exemplary embodiment, the first block 12 and the fourth block 15 are substantially the same. The first block 12 will be described in greater detail and this description is applicable to the fourth block 15 and description of the fourth block 15 is applicable to the first block 12. Also, in the exemplary embodiment, the second block 14 and the third block 16 are substantially the same. The second block 14 will be described in greater detail and this description is applicable to the third block 13 and description of the third block 13 is applicable to the second block 14. The exemplary blocks 12, 14, 13, 15 are cubic and can be formed from any material. The exemplary blocks 12, 14, 13, 15 can be formed from aluminum.

The first block 12 can define a plurality of first reference surfaces and a plurality of first notches. The plurality of first reference surfaces can include a first work-engaging surface 16 and a first block-engaging surface 18. The exemplary first work-engaging surface 16 and the first block-engaging surface 18 are perpendicular to one another. The first work-engaging surface 16 can have a first predetermined level of flatness and thereby configured to lay flush on a first surface portion of a workpiece 20. The first block-engaging surface 18 can have a third level of flatness and can thereby be configured to lay flush with respect to the second block 14. It is noted that the terms "work-engaging" and "block-engaging" are used for reference only; the surfaces so designated can lay flush with either the workpiece 20 of with another block.

The plurality of first notches can include a vertical notch 22 and a horizontal notch 24. It is noted that the terms "vertical" and "horizontal" are used only to distinguish the notches 22, 24; the notches so designated can be oriented vertically upward/downward or horizontally side-to-side as the device 10 is used. Each notch is centered on an axis. The vertical notch 22 can be centered on an axis 26 and the horizontal notch 24 can be centered on an axis 28. The axis 26 is transverse to the first work-engaging surface 16 and the axis 28 is transverse to first block-engaging surface 18. "Transverse" is any angle greater than zero, up to ninety degrees. The exemplary axis 26 is perpendicular to the first work-engaging surface 16 and the exemplary axis 28 is perpendicular to first block-engaging surface 18. As will be set forth in greater detail below, each of the plurality of first notches 22, 24 can be configured to form one radial half of a punch aperture.

The second block 14 can define a plurality of second reference surfaces and a plurality of second notches. The plurality of second reference surfaces can include a second work-engaging surface 30 and a second block-engaging surface 32. The exemplary second work-engaging surface 30 and the second block-engaging surface 32 are perpendicular to one another. The second work-engaging surface 30 can have the first predetermined level of flatness and thereby configured to lay flush on a second surface portion of a workpiece 20. The first and second surface portions of the workpiece 20 can be in the same plane or in different planes. The second block-engaging surface 32 can have the third level of flatness and can thereby be configured to lay flush with respect to the first block-engaging surface 18 of the first block 12.

The plurality of second notches can include a vertical notch 34 and a horizontal notch 36. It is noted that the terms "vertical" and "horizontal" are used the distinguish directions only; the notches so designated can be oriented vertically upward/downward or horizontally side-to-side as the device 10 is used. Each notch is centered on an axis. The vertical notch 34 can be centered on the axis 26 when the blocks 12, 14 are abutting one another and in contact through the block-engaging surfaces 18, 32. The horizontal notch 36 can be centered on the axis 28 when the blocks 12, 14 are abutting one another and in contact the block-engaging surfaces 18, 32. The axis 26 is transverse to the second work-engaging surface 30 and the axis 28 is transverse to second block-engaging surface 32. "Transverse" is any angle greater than zero, up to ninety degrees. The exemplary axis 26 is perpendicular to the second work-engaging surface 30 and the exemplary axis 28 is perpendicular to second block-engaging surface 32.

The notches 22 and 34 can each define one radial half of a punch aperture. An exemplary punch is referenced at 38 in FIG. 2. The punch 38 extends along a centered punch axis 40 between an anvil end 42 and a marking end 44. The punch 38 is receivable in a punch aperture defined between two of the blocks 12, 14 or 14, 13 or 13, 15. The exemplary punch aperture defined between the blocks 13, 15 is the same size and configuration as the punch aperture defined between the blocks 12, 14 by the notches 22 and 34.

The exemplary punch 38 is slidable in the punch aperture during the marking operation. "Slidable" refers to contact between the surfaces defining the punch aperture and the punch 38 during movement of the punch 38. The exemplary notches 22, 34 are semi-cylindrical and therefore define a circular aperture, but could be any shape desired. It is also noted that the notch 22 could mate with the notch 36 if desired and define a punch aperture. Likewise, the notch 24 could mate with the notch 34 if desired, and the notch 24 could mate with the notch 36 if desired.

The punch centering block device 10 also includes linkages connecting adjacent blocks to one another. The linkage between the first and second blocks 12, 14 will be described in greater detail and this description is applicable to the linkages between other pairs of blocks. The exemplary linkage between the blocks 12, 14 includes a first rod 46 extending through the first block 12. The first rod 46 has first and second heads 62, 64 at opposite ends. The exemplary linkage between the blocks 12, 14 also includes a second rod 48 extending through the second block 14 and having third and fourth heads 50, 52 at opposite ends. A cross-section of the second rod 48 is shown in FIG. 12 and the first rod 46 is structurally similar. The exemplary linkage between the blocks 12, 14 includes first and second guide rails 54, 56. Each rail 54, 56 has a closed slot 58, 60 receiving both of the first rod 46 and the second rod 48. Each slot 58, 60 is smaller than the heads so that the first rod 46 and the second rod 48 can slide in the first and second guide rails 54, 56 without separating from the guide rails 54, 56.

The exemplary linkage interconnecting the first block 12 and the second block 14 thus permits movement of the first block 12 and the second block 14 relative to one another over a range of closeness, between contact together and a maximum distance apart. At the maximum distance apart, the first block 12 and the second block 14 are rotatable relative to one another. This is demonstrated by comparing FIGS. 1, 7, 10, and 11.

The exemplary punch centering block device 10 can also include a plurality of magnets and steel inserts including at least one magnet and at least one steel insert mounted in the first block 12 and at least one magnet mounted and at least one steel insert in the second block 14. The plurality of magnets can include a magnet 68 positioned at the first work-engaging surface 16 so as to be configured to engage the first block 12 to the workpiece 20. The plurality of magnets can also include a magnet 72 positioned at the second work-engaging surface 30 so as to be configured to engage the second block 14 to the workpiece 20. The plurality of magnets can also include a magnet 74 positioned at the first block-engaging surface 18 and a magnet 80 positioned at the second block-engaging surface 32 so as to be configured to engage the first block 12 to the second block. The plurality of steel inserts can include a steel insert 66 positioned at the first work-engaging surface 16 so as to be configured to engage the magnet 72 if desired. The plurality of steel inserts can also include a steel insert 70 positioned at the second work-engaging surface 30 so as to be configured to engage the magnet 68 is desired. The plurality of steel inserts can also include a steel insert 76 positioned at the first block-engaging surface 18 to engage the magnet 80 if desired, to engage the first block 12 to the second block 14. The plurality of steel inserts can also include a steel insert 78 positioned at the second block-engaging surface 32 to engage the magnet 74 if desired, to engage the first block 12 to the second block 14. As shown in the drawings, the various magnets and steel inserts can be combined in various ways to engage various surfaces together. A magnet and a steel insert can be positioned at each engaging surface.

The punch centering block device 10 can also include a plurality of levels. The plurality of levels can include at least one level mounted in the first block 12 and at least one level mounted in the second block 14. In the exemplary embodiment, as referenced in FIG. 10, the plurality of levels can include a horizontal level 82 mounted in the first block 12 and a vertical level 84 mounted in the second block 14.

Figure 2:
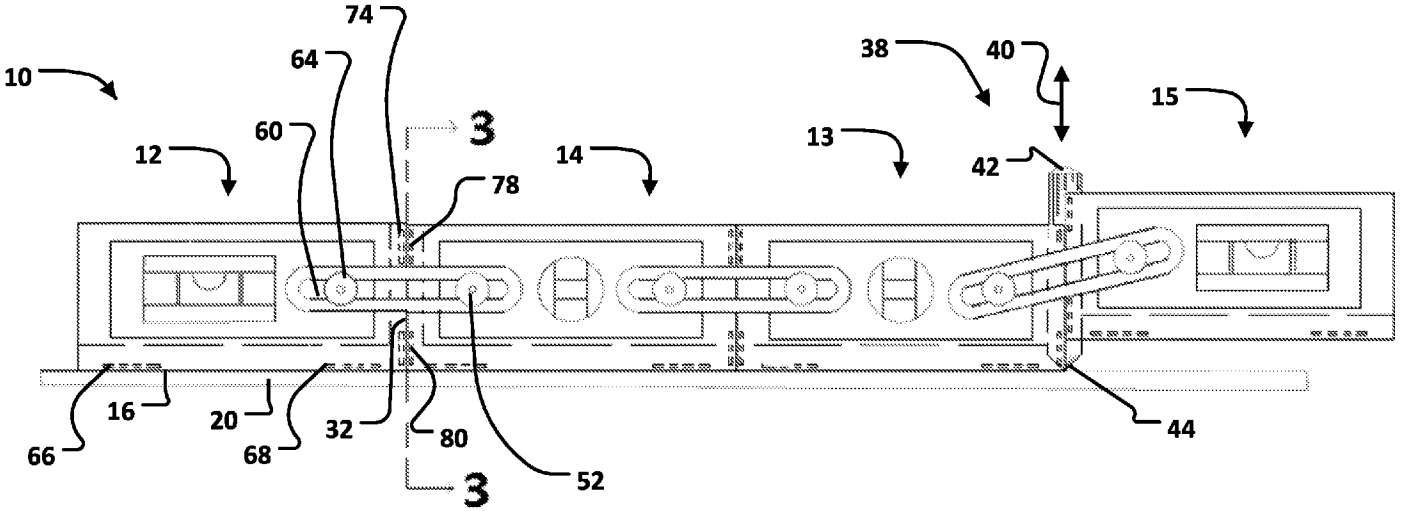
FIG. 2 is a front view of the punch centering block device shown in FIG. 1 with one of the blocks elevated relative to the other blocks.
Figure 3:
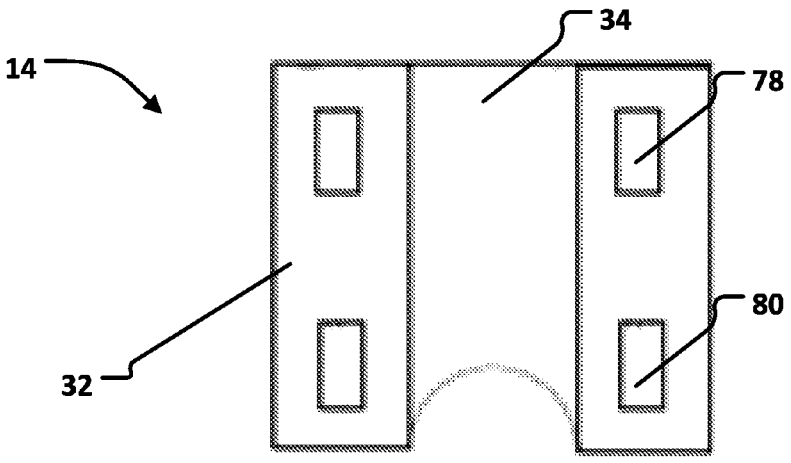
FIG. 3 is view taken along section lines 3-3 in FIG. 2.

The punch centering block device 10 can also include a plurality of sleeves sized to fit into the punch apertures defined by the various blocks. Each of the plurality of sleeves can have a differently sized inner diameter to accommodate punches of different size. FIGS. 8A1 and 8A2 show a first sleeve 86 having a first inner diameter 88. FIGS. 8B1 and 8B2 show a second sleeve 90 having a second inner diameter 92, less than the first inner diameter 88. FIGS. 8C1 and 8C2 show a third sleeve 94 having a third inner diameter 96, less than the second inner diameter 92.

Figure 4:
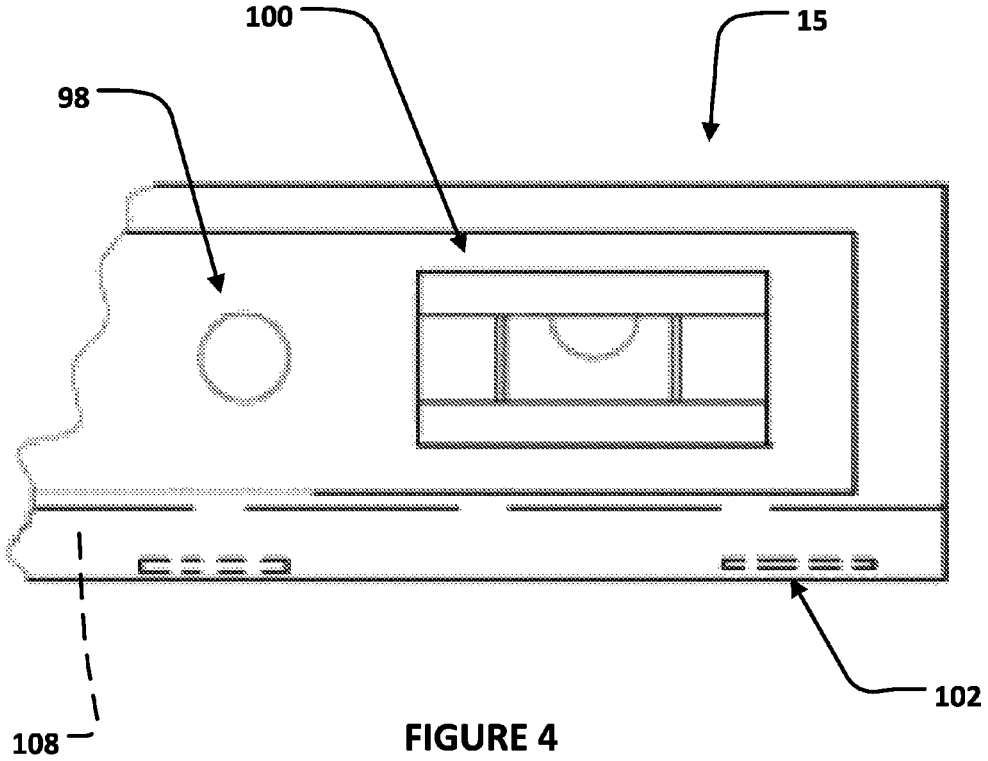
FIG. 4 is a partial front view of one of the blocks with linking hardware removed.
Figure 5:
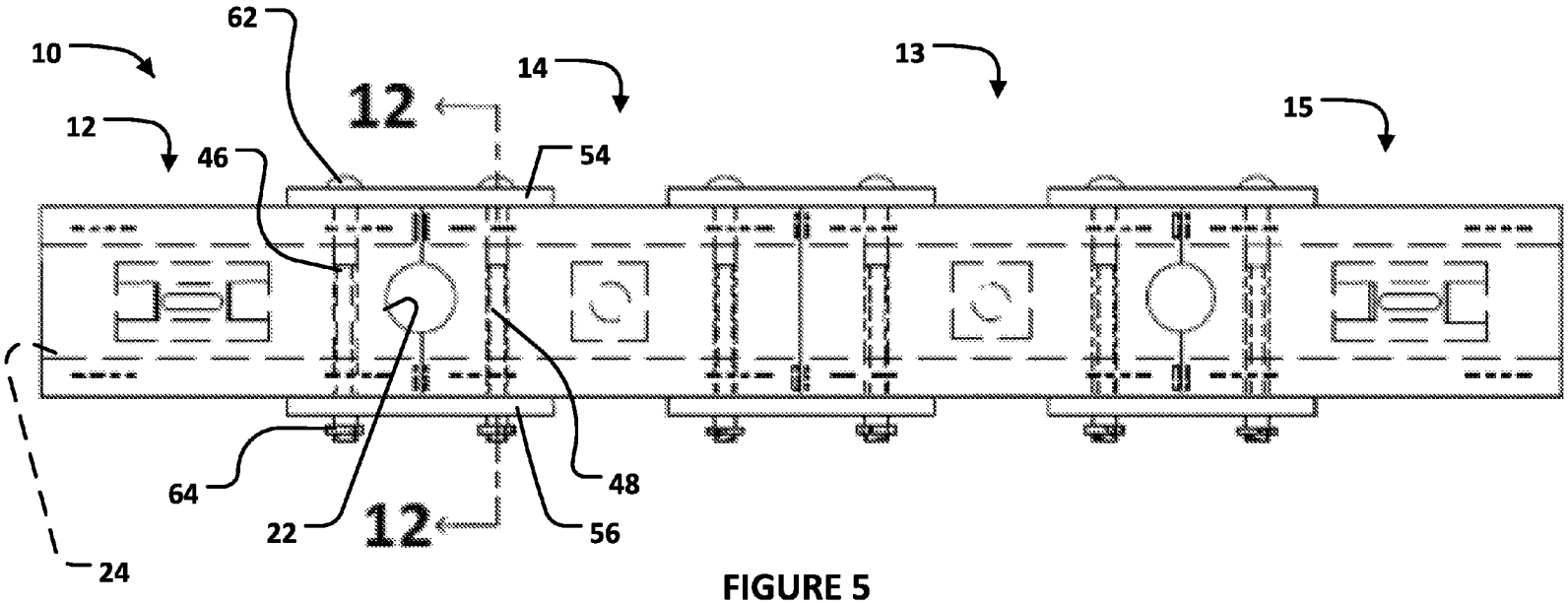
FIG. 5 is a top view of the punch centering block device shown in FIG. 1.
Figure 6:
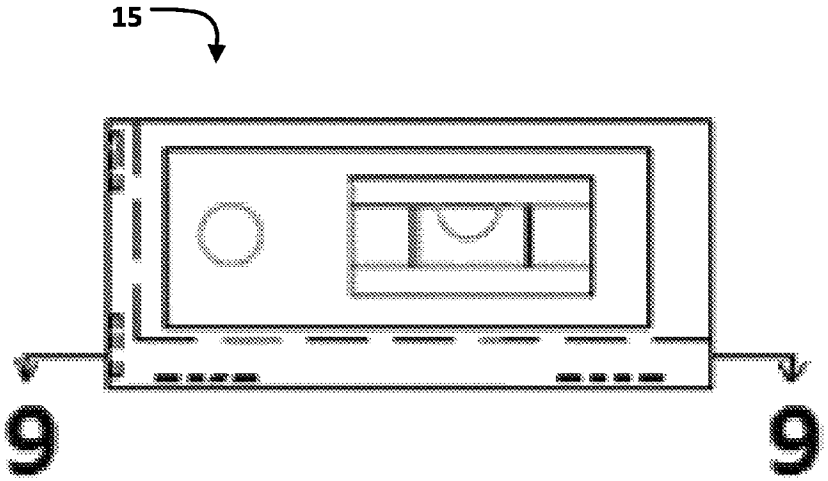
FIG. 6 is a front view of one of the blocks with linking hardware removed.
Figure 7:
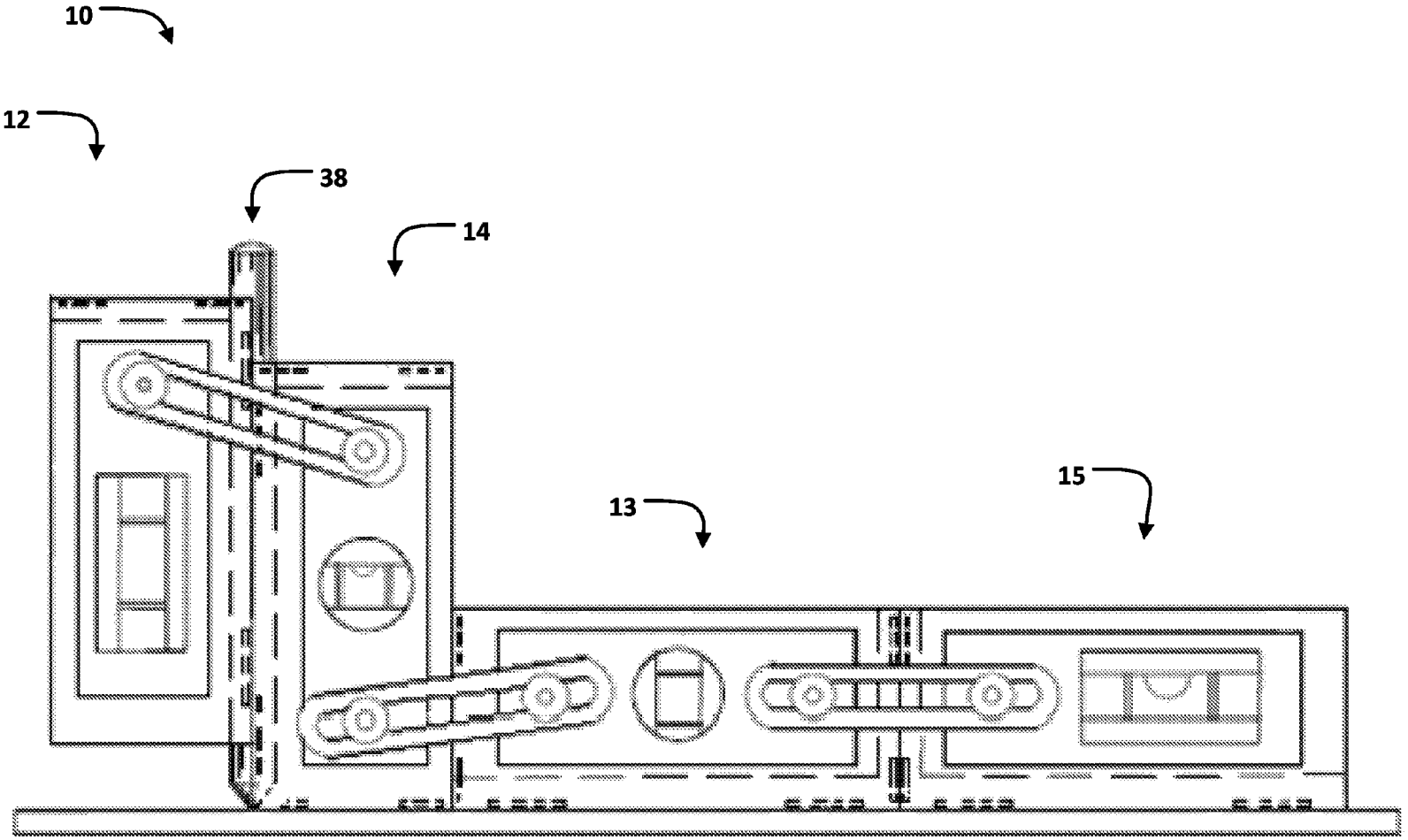
FIG. 7 is a front view of the punch centering block device shown in FIG. 1 with two of the blocks rotated relative to the other blocks.
Figure 10:
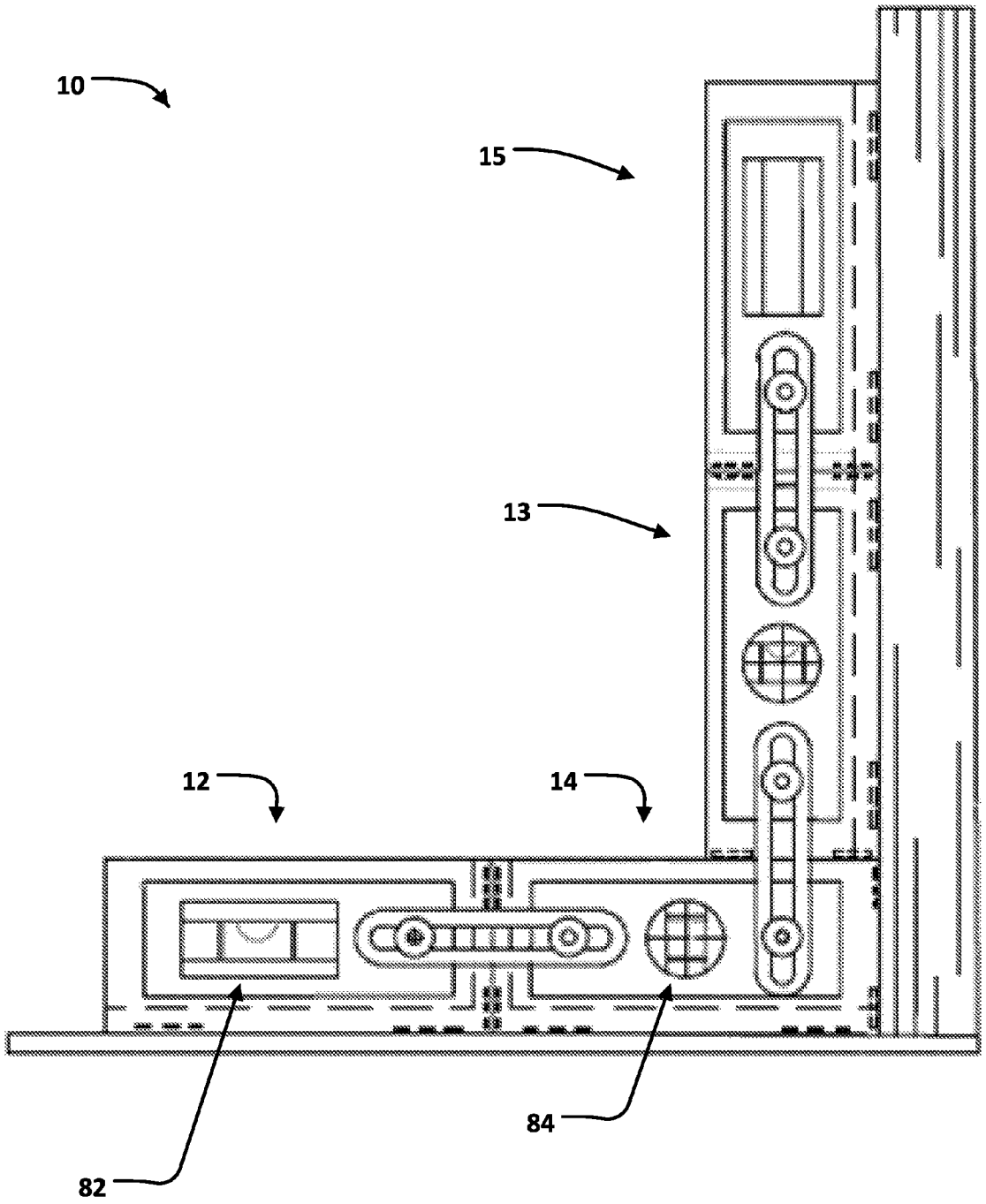
FIG. 10 is a front view of the punch centering block device shown in FIG. 1 with two of the blocks rotated relative to the other blocks.
Figure 11:
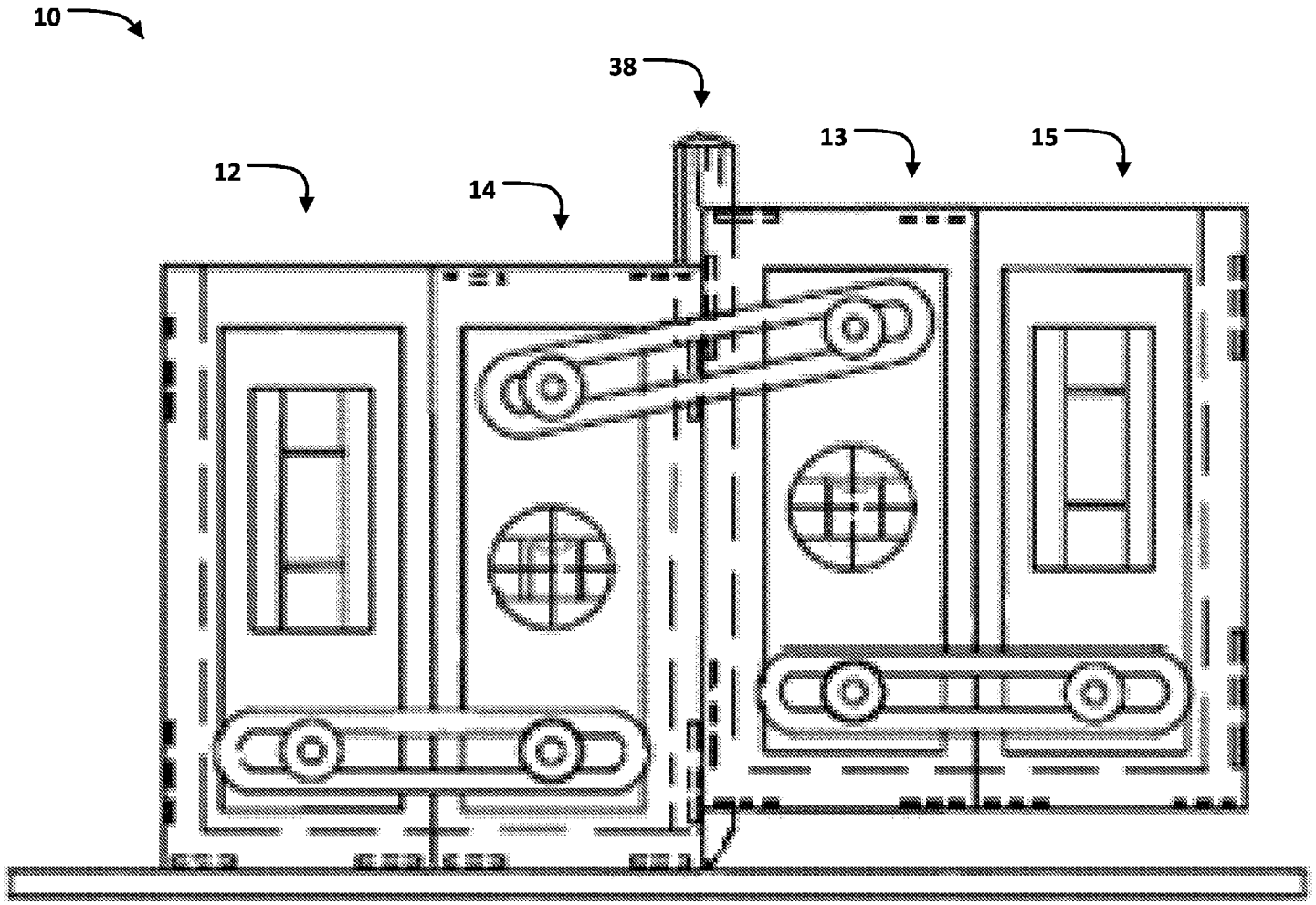
FIG. 11 is a front view of the punch centering block device shown in FIG. 1 with all of the blocks rotated relative to the positions shown in FIG. 1.

FIGS. 4, 6 and 9 are views of the fourth block 15. The exemplary fourth block 15 includes an aperture 98 for receiving a rod of a linkage, a horizontal level 100, and a magnet 102. In FIG. 9, a horizontal slot 104 of the block 15 has received a sleeve 106 and a punch 108.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A punch centering block device comprising:

a first block defining at least one first reference surface and at least one first notch extending along a centered first axis, said at least one first reference surface having a first predetermined level of flatness and thereby configured to lay flush on a first surface portion of a workpiece and said first axis transverse to said at least one first reference surface;

a second block defining at least one second reference surface and at least one second notch extending along a centered second axis, said at least one second reference surface having a second predetermined level of flatness and thereby configured to lay flush on a second surface portion of the workpiece and said second axis transverse to said at least one second reference surface; and wherein said first block and said second block are configured to selectively abut one another and render said first axis and second axis collinear such that said at least one first notch defines a first radial half of a punch aperture configured to receive a punch during a marking operation and said at least one second notch defines a second radial half of said punch aperture, the punch slidable against said at least one first notch and said at least one second notch within said punch aperture during the marking operation.

2. The punch centering block device of claim 1 wherein at least one of said at least one first notch and said at least one second notch is semi-cylindrical.

3. The punch centering block device of claim 2 wherein both of said at least one first notch and said at least one second notch are semi-cylindrical.

4. The punch centering block device of claim 1 wherein:

said at least one first reference surface is further defined as a plurality of first reference surfaces including a first work-engaging surface and a first block-engaging surface, said first work-engaging surface having said first predetermined level of flatness and thereby configured to lay flush on the first surface portion of the workpiece, said at least one first notch defined in said first block-engaging surface;

said at least one second reference surface is further defined as a plurality of second reference surfaces including a second work-engaging surface and a second block-engaging surface, said second work-engaging surface having said second predetermined level of flatness and thereby configured to lay flush on the second surface portion of the workpiece, said at least one second notch defined in said second block-engaging surface; and said first block-engaging surface and said second block-engaging surface having a third level of flatness and thereby configured to lay flush with respect to one another to guide movement of the punch with said punch aperture.

5. The punch centering block device of claim 4 further comprising:

a plurality of magnets including at least one magnet mounted in said first block at said first work-engaging surface and at least one magnet mounted in said first block at said first block-engaging surface.

6. The punch centering block device of claim 5 wherein said plurality of magnets further comprises:

at least one magnet mounted in said second block at said second work-engaging surface and at least one magnet mounted in said second block at said second block-engaging surface.

7. The punch centering block device of claim 4 wherein:

said at least one first notch further comprises a plurality of first notches, including a third notch defined in said first block-engaging surface and a fourth notch defined in said first work-engaging surface; and said at least one second notch further comprises a plurality of second notches, including a fifth notch defined in said first block-engaging surface and a sixth notch defined in said first work-engaging surface.

8. The punch centering block device of claim 4 wherein said first level of flatness, said second level of flatness, and said third level of flatness are substantially the same and said first block-engaging surface and said second block-engaging surface are thereby configured to lay flush on respective third and fourth surface portions of the workpiece.

9. The punch centering block device of claim 1 wherein said at least one first notch is further defined as a plurality of first notches each extending along respective, centered first axes, each of said plurality of first notches configured to form one radial half of said punch aperture.

10. The punch centering block device of claim 9 wherein:

said at least one second notch is further defined as a plurality of second notches each extending along respective, centered second axes, each of said plurality of second notches configured to form one radial half of said punch aperture; and each of said plurality of first notches is configured to aligned with more than one of said plurality of second notches.

11. The punch centering block device of claim 1 further comprising:

a linkage interconnecting said first block and said second block, wherein said linkage permits movement of said first block and said second block relative to one another including a range of closeness between contact together and a maximum distance apart.

12. The punch centering block device of claim 11 wherein said linkage is configured such that said first block and said second block are rotatable relative to one another when at said maximum distance apart.

13. The punch centering block device of claim 11 wherein said linkage further comprises:

a first rod extending through said first block and having first and second heads at opposite ends;

a second rod extending through said second block and having third and fourth heads at opposite ends;

first and second guide rails, each having a closed slot receiving both of said first rod and said second rod, wherein said slot is smaller than said first head, said second head, said third head, and said fourth head whereby said first rod and said second rod can slide in said first and second guide rails without separating from said guide rails.

14. The punch centering block device of claim 1 further comprising:

a plurality of magnets including at least one magnet mounted in said first block and at least one magnet mounted in said second block.

15. The punch centering block device of claim 14 wherein said plurality of magnets are positioned so as to be configured to engage said first block and said second block with the workpiece and to engage said first block and said second block with one another.

16. The punch centering block device of claim 1 further comprising:

a plurality of levels including at least one level mounted in said first block and at least one level mounted in said second block.

17. The punch centering block device of claim 16 wherein said plurality of levels further comprise:

a horizontal level mounted in said first block; and a vertical level mounted in said second block.

18. The punch centering block device of claim 1 further comprising:

a plurality of sleeves sized to fit into said punch aperture defined by said first block and said second block, each of said plurality of sleeves having a differently sized inner diameter to accommodate punches of different size.

19. The punch centering block device of claim 1 further comprising:

a third block defining at least one third reference surface and at least one third notch extending along a centered third axis, said at least one third reference surface having a third predetermined level of flatness and thereby configured to lay flush on a third surface portion of the workpiece and said third axis transverse to said at least one third reference surface; and wherein said third block and said second block are configured to selectively abut one another and render said third axis and second axis collinear such that said at least one third notch defines a first radial half of a second punch aperture configured to receive the punch during a marking operation and said at least one second notch defines a second radial half of said second punch aperture, the punch slidable against said at least one third notch and said at least one second notch within said punch aperture during the marking operation.

20. The punch centering block device of claim 1 further comprising:

a punch extending along a centered punch axis between an anvil end and a marking end and receivable in said punch aperture.

* * * * *